US010582323B2

(12) United States Patent
Ji et al.

(10) Patent No.: US 10,582,323 B2
(45) Date of Patent: Mar. 3, 2020

(54) SPEAKER MODULE HOUSING AND MANUFACTURING METHOD THEREOF

(71) Applicant: GOERTEK INC., Weifang, Shandong (CN)

(72) Inventors: Pengcheng Ji, Weifang (CN); Xinfeng Yang, Weifang (CN)

(73) Assignee: GOERTEK INC., Weifang, Shandong (CN)

( * ) Notice: Subject to any disclaimer, the term of this patent is extended or adjusted under 35 U.S.C. 154(b) by 0 days.

(21) Appl. No.: 16/083,617

(22) PCT Filed: May 17, 2016

(86) PCT No.: PCT/CN2016/082369
§ 371 (c)(1),
(2) Date: Sep. 10, 2018

(87) PCT Pub. No.: WO2017/161653
PCT Pub. Date: Sep. 28, 2017

(65) Prior Publication Data

US 2019/0098422 A1 Mar. 28, 2019

(30) Foreign Application Priority Data

Mar. 21, 2016 (CN) ..... 2016 1 0160887

(51) Int. Cl.
*H04R 31/00* (2006.01)
*H04R 1/02* (2006.01)
*H04R 3/00* (2006.01)

(52) U.S. Cl.
CPC ..... *H04R 31/00* (2013.01); *H04R 1/025* (2013.01); *H04R 3/002* (2013.01); *H04R 2499/11* (2013.01)

(58) Field of Classification Search
CPC ..... H04R 31/00; H04R 1/02; H04R 1/025
See application file for complete search history.

(56) References Cited

U.S. PATENT DOCUMENTS 8,761,432 B1 6/2014 Cheng

FOREIGN PATENT DOCUMENTS

| | | | |
|---|---|---|---|
| CN | 102045614 | A | 5/2011 |
| CN | 202841500 | U | 3/2013 |
| CN | 103686551 | A | 3/2014 |
| CN | 203912123 | U | 10/2014 |

(Continued)

OTHER PUBLICATIONS

English machine translation of CN203984674 (Guo, Loudspeaker Module, published Dec. 2014).*

*Primary Examiner* — Mark Fischer
(74) *Attorney, Agent, or Firm* — Saliwanchik, Lloyd & Eisenschenk

(57) ABSTRACT

Disclosed are a speaker module housing and a manufacturing method thereof. The speaker module housing comprises an upper housing, a lower housing, an annular connection member and a plate member. The annular connection member comprises a fixing portion and a connection portion. A speaker unit assembling hole is formed in the upper housing. The fixing portion of the annular connection member is fixedly connected with the speaker unit assembling hole. The connection portion of the annular connection member is electrically connected with the plate member.

9 Claims, 2 Drawing Sheets

(56) References Cited

FOREIGN PATENT DOCUMENTS

| | | | |
|---|---|---|---|
| CN | 203984674 | U | 12/2014 |
| CN | 104811857 | A | 7/2015 |
| CN | 204697285 | U | 10/2015 |
| CN | 204948356 | U | 1/2016 |
| CN | 205029868 | U | 2/2016 |
| CN | 105657618 | A | 6/2016 |
| WO | 2004080116 | A2 | 9/2004 |

* cited by examiner

SPEAKER MODULE HOUSING AND MANUFACTURING METHOD THEREOF

CROSS REFERENCE TO RELATED APPLICATIONS

This application is a National Stage of International Application No. PCT/CN2016/082369, filed on May 17, 2016, which claims priority to Chinese Patent Application No. 201610160887.X, filed on Mar. 21, 2016, both of which are hereby incorporated by reference in their entireties.

FIELD OF THE INVENTION

The present invention relates to the technical field of electroacoustic products, and in particular, to a speaker module housing and a manufacturing method thereof.

BACKGROUND OF THE INVENTION

A speaker, as a sound generation component of an electronic product such as a mobile phone, a television and a computer, is widely applied to people's daily production and life. Currently, common speakers mainly comprise moving-coil speakers, electromagnetic speakers, capacitive speakers, piezoelectric speakers, and the like. The moving-coil speakers are more popular due to the advantages of a relatively simple production process, low cost, and better low frequency sound generation performance, etc.

The existing moving-coil speaker is also called as a moving-coil speaker module which generally comprises a speaker module housing and a speaker unit. The speaker module housing comprises an upper housing and a lower housing which are assembled together to form a chamber for accommodating the speaker unit.

As people's requirements on the acoustic performance of the moving-coil speaker become stricter, the technology that uses capacitance to feed back a vibration displacement of a vibration diaphragm of a speaker unit is widely used. Particularly, in this technology, it is required to mold a steel sheet through injection on an upper housing of a speaker module housing as an upper plate of a capacitor, and arrange another steel sheet on a dome of a speaker unit as a lower plate of the capacitor. When the moving-coil speaker works, the capacitance of the capacitor changes. Thus, by using the capacitance change of the capacitor to feed back the vibration displacement of the vibration diaphragm, a purpose of improving the acoustic performance of the speaker is realized by monitoring the vibration displacement of the vibration diaphragm of the speaker unit.

The speaker unit of the integrated speaker module is not a separate component, and all components of the speaker unit are directly assembled in the upper housing of the speaker module housing, so that all the components of the speaker unit cannot be assembled in the speaker module housing after the steel sheet is molded through injection on the upper housing of the speaker module housing. That is, as the technology using capacitance to feed back the vibration displacement of the vibration diaphragm requires molding the steel sheet through injection on the upper housing first, it cannot be applied to the integrated speaker module, which directly hinders the improvement of the acoustic performance of the integrated speaker module.

SUMMARY OF THE INVENTION

An object of the present invention is to provide a speaker module housing for applying the technology that uses capacitance to feed back a vibration displacement of a vibration diaphragm to an integrated speaker module.

According to a first aspect of the present invention, there is provided a speaker module housing, comprising an upper housing, a lower housing, an annular connection member and a plate member. The annular connection member comprises a fixing portion and a connection portion. A speaker unit assembling hole is formed in the upper housing. The fixing portion of the annular connection member is fixedly connected with the speaker unit assembling hole. The connection portion of the annular connection member is electrically connected with the plate member.

Preferably, the connection portion is located in an inner ring of the annular connection member; and the fixing portion is located in an outer ring of the annular connection member.

More preferably, a plurality of grooves and at least one signal acquisition leg are arranged at the edge of the fixing portion.

Further, the annular connection member comprises a first side, a second side, a third side and a fourth side which are connected with one another end to end. The first side corresponds to the third side; and the second side corresponds to the fourth side. The first and third sides are shorter than the second and fourth sides. The sizes of the grooves in the first and third sides are smaller than those of the grooves in the second and fourth sides.

Furthermore, there is one signal acquisition leg which extends from the edge of the second or fourth side towards a direction away from the lower housing.

Preferably, the shape of the plate member is matched with that of the inner ring of the annular connection member.

Preferably, the connection portion of the annular connection member is electrically connected with the plate member through a conductive adhesive.

Preferably, the annular connection member is an annular steel sheet.

Preferably, the annular connection member is designed as an insert fixedly connected with the upper housing through injection molding.

Another object of the present invention is to provide a manufacturing method of a speaker module housing, so as to favorably combine an upper housing and an annular connection member.

According to a second aspect of the present invention, there is provided a manufacturing method of an upper housing of a speaker module housing. The manufacturing method comprises the following steps: step 1), fixing a fixing portion of an annular connection member as an insert in a speaker unit assembling hole of the upper housing of the speaker module housing through injection molding; and step 2), electrically connecting the plate member with a connection portion of the annular connection member described in step 1) through a conductive adhesive.

The inventor of the present invention finds that in the prior art, there is a problem that the technology using capacitance to feed back a vibration displacement of a vibration diaphragm cannot be applied to an integrated speaker module as it requires molding a steel sheet through injection on the upper housing first. Therefore, the technical task to be achieved or the technical problem to be solved by the present invention is unintentional or unanticipated for those skilled in the art, and thus the present invention refers to a novel technical solution.

A beneficial effect of the present invention is that in the speaker module housing provided by the present invention, by fixedly connecting the annular connection member at the speaker unit assembling hole of the upper housing, it is ensured that all components of the speaker unit can be assembled in the upper housing through the speaker unit assembling hole. Moreover, the plate member and the annular connection member are connected together, so that the technology using capacitance to feed back the vibration displacement of the vibration diaphragm can be applied to the integrated speaker module, thereby facilitating the improvement of the acoustic performance of the integrated speaker module.

Another beneficial effect of the present invention is that in the manufacturing method provided by the present invention, the annular connection member as the insert is fixed in the upper housing of the speaker module housing through injection molding, so that the connection strength between the annular connection member and the upper housing is effectively improved and a combining force is higher. Moreover, the operation that the plate member and the annular connection member are electrically connected through the conductive adhesive is convenient, so that the improvement of the production efficiency is facilitated.

Further features of the present invention and advantages thereof will become apparent from the following detailed description of exemplary embodiments according to the present invention with reference to the accompanying drawings.

BRIEF DESCRIPTION OF THE DRAWINGS

The accompanying drawings, which are incorporated in and constitute a part of the description, illustrate embodiments of the present invention and, together with the description thereof, serve to explain the principles of the present invention.

Figure 1:
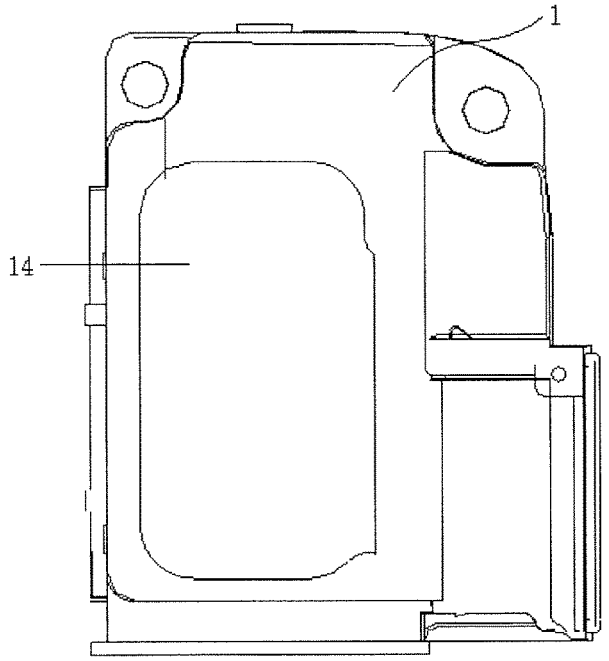
FIG. 1 is a schematically structural view of a speaker module housing according to an embodiment of the present invention.

Reference numerals: 1, speaker module housing; 11, upper housing; 111, speaker unit assembling hole; 12, lower housing; 13, annular connection member; 131, fixing portion; 132, connection portion; 133, groove; 134, signal acquisition leg; 135, first side; 136, second side; 137, third side; 138, fourth side; and 14, plate member.

DETAILED DESCRIPTION OF THE EMBODIMENTS

Various exemplary embodiments of the present invention will now be described in detail with reference to the drawings. It should be noted that the relative arrangement of the components and steps, the numerical expressions, and numerical values set forth in these embodiments do not limit the scope of the present invention unless it is specifically stated otherwise.

The following description of at least one exemplary embodiment is merely illustrative in nature and is in no way intended to limit the present invention, its application, or uses.

Techniques, methods and equipment as known by one of ordinary skill in the related art may not be discussed in detail but are intended to be part of the description where appropriate.

In all of the examples illustrated and discussed herein, any specific values should be interpreted to be illustrative only and non-limiting. Thus, other examples of the exemplary embodiments could have different values.

Notice that similar reference numerals and letters refer to similar items in the following figures, and thus once an item is defined in one figure, it is possible that it need not be further discussed in the accompanying drawings.

Figure 2:
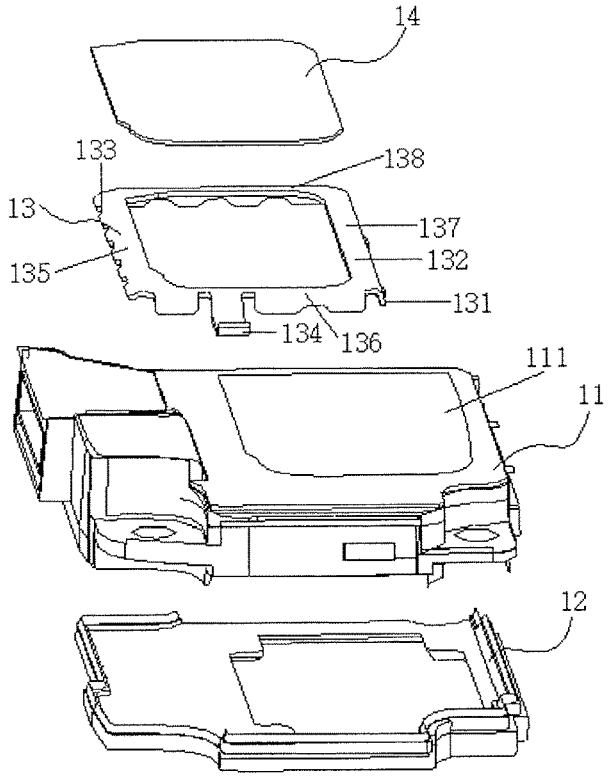
FIG. 2 is an exploded view of FIG. 1.

In order to solve the problem that the technology using capacitance to feed back a vibration displacement of a vibration diaphragm cannot be applied to an integrated speaker module, the present invention provides a speaker module housing. As shown in FIGS. 1 and 2, the speaker module housing comprises an upper housing 11, a lower housing 12, an annular connection member 13 and a plate member 14. The annular connection member 13 comprises a fixing portion 131 and a connection portion 132. The plate member 14 may serve as a plate of a capacitor, and may be a steel plate generally. A speaker unit assembling hole 111 is formed in the upper housing 11. The fixing portion 131 of the annular connection member 13 is fixedly connected with the speaker unit assembling hole 111. The connection portion 132 of the annular connection member 13 is electrically connected with the plate member 14. It should be clear to those skilled in the art that the upper housing 11 is the upper housing of the integrated speaker module, and the speaker unit assembling hole 111 of the upper housing 11 is used in assembling of all components of a speaker unit. That is, all components of the speaker unit may be assembled into the upper housing 11 through the speaker unit assembling hole 111. The fixing portion 131 of the annular connection member 13 and the speaker unit assembling hole 111 may be fixedly connected through injection molding, gluing, or the like. The connection portion 132 of the annular connection member 13 may be electrically connected with the plate member 14 through welding, a conductive adhesive or a conductor. The assembling of the upper housing 11 and the lower housing 12 may be implemented through well-known means such as gluing or ultrasonic sealing in the field, which is not further limited in the present invention.

In this way, the annular connection member 13 does not block the speaker unit assembling hole, and can be fixedly connected to the speaker unit assembling hole 111 of the upper housing 11 before or after other components of the speaker unit are assembled to the upper housing 11. Then, the plate member 14 is electrically connected to the annular connection member 13. Of course, those skilled in the art can easily conceive of additionally arranging the other plate corresponding to the plate member 14 on the dome, so as to monitor the vibration displacement of a vibration diaphragm according to the change of the capacitance of a capacitor composed of the plate member 14 and the other plate.

In the speaker module housing provided by the present invention, by fixedly connecting the annular connection member 13 at the speaker unit assembling hole 11 of the upper housing 11, it is ensured that other components of the speaker unit can be assembled in the upper housing 11 through the speaker unit assembling hole 111. Moreover, the plate member 14 and the annular connection member 13 are connected together, so that the technology using capacitance to feed back the vibration displacement of the vibration diaphragm can be applied to the integrated speaker module, thereby facilitating the improvement of the acoustic performance of the integrated speaker module.

In a specific embodiment as shown in FIG. 2, the connection portion 132 is located in an inner ring of the annular connection member 13; and the fixing portion 131 is located in an outer ring of the annular connection member 13. Through the design that the connection portion 132 and the fixing portion 131 are respectively located in the inner and outer rings of the annular connection member 13, the annular structure of the annular connection member 13 is utilized more effectively and rationally, so as to prevent the fixing portion 131 or the connection portion 132 from interfering with the assembling of other components of the speaker unit into the upper housing 11. The connection between the fixing portion 131 and the connection portion 132 may be a smooth transition or an angled transition, which is not further defined in the present invention.

In order to improve the reliability of the connection between the fixing portion 131 and the upper housing 11, a plurality of grooves 133 is formed in the edge of the fixing portion 131. With the grooves 133, a combining force between the fixing portion 131 and the speaker unit assembling hole 111 is increased. Moreover, the annular connection member 13 which is generally thin and small in size is likely to deform due to a concentrated stress when being combined with the upper housing 11. Through the grooves 133, the concentrated stress generated when the annular connection member 13 is combined with the upper housing 11 can be easily dispersed and reduced, so that the connection between the annular connection member 13 and the plate member 14 is prevented from being influenced by the deformation of the annular connection member 13. In addition, at least one signal acquisition leg 134 is further arranged at the edge of the fixing portion 131. After the signal acquisition leg 134 and related wires are connected, related capacitance data of the plate member 14 can be output to achieve acquisition of the capacitance data. Those skilled in the art will appreciate how to acquire the data output by the signal acquisition leg 134, which will not be repeated herein.

Further, in order to improve the stability of the structure of the annular connection member 13 and prevent the annular connection member 13 from deformation, the annular connection member 13 comprises a first side 135, a second side 136, a third side 137 and a fourth side 138 which are connected with one another end to end. The first side 135 corresponds to the third side 137; and the second side 136 corresponds to the fourth side 138. The first and third sides 135 and 137 are shorter than the second and fourth sides 136 and 138. The sizes of the grooves 133 in the first and third sides 135 and 137 are smaller than those of the grooves 133 in the second and fourth sides 136 and 138. The design that the larger grooves 133 are formed in the longer sides is favorable for dispersion and reduction of the concentrated force generated when the annular connection member 13 is combined with the upper housing 11 to the greatest extent on the premise that the structure of the annular connection member 13 is stable, so that the annular connection member 13 is effectively prevented from deformation. The above definitive terms "first", "second", "third" and "fourth" are only configured to distinguish the sides of the annular connection member 13.

There is one signal acquisition leg 134 as excessive signal acquisition legs 134 will affect the connection between the annular connection member 13 and the speaker unit assembling hole 111 as well as the structural stability of the annular connection member 13. Moreover, the signal acquisition leg 134 extends from the edge of the second side 136 or the fourth side 138 towards a direction away from the lower housing 12.

In a preferred embodiment of the present invention, the shape of the plate member 14 is matched with that of the inner ring of the annular connection member 13. Through this design, the connection strength between the plate member 14 and the annular connection member 13 can be advantageously improved.

In order to connect the annular connection member 13 and the plate member 14 more conveniently, the connection portion 132 of the annular connection member 13 is electrically connected with the plate member 14 through a conductive adhesive (not shown in the figures).

In order to provide a proper rigidity to the annular connection member 13 whose thickness is as small as possible, or to provide the greatest rigidity to the annular connection member 13 whose thickness is constant, the annular connection member 13 adopts an annular steel sheet, and may adopt other conductive alloys. However, based on cost control, the adoption of the annular steel sheet as the annular connection member 13 is a preferred embodiment.

In order to manufacture the speaker module housing 1 more conveniently on the premise that the combining reliability of the annular connection member 13 and the speaker unit mounting hole 111 of the upper housing 11 is ensured, the annular connection member 13 is designed as an insert fixedly connected with the upper housing 11 through injection molding. That is, the annular connection member 13 is placed in a mold of the upper housing 11 as the insert, and corresponds to a portion of the mold for molding the speaker unit assembling hole 111. In this way, the annular connection member 13 and the molded upper housing 11 can be fixedly connected as a whole.

Figure 3:
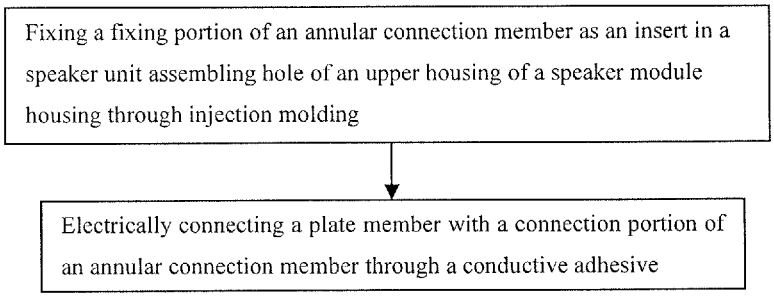
FIG. 3 is a flow chart of a manufacturing method of an upper housing of a speaker module housing according to an embodiment of the present invention.

The present invention further provides a manufacturing method of an upper housing of a speaker module housing, so as to favorably combine the upper housing 11 and an annular connection member 13. FIG. 3 shows an implementation of the manufacturing method. The manufacturing method comprises the following steps.

In step 1), a fixing portion 131 of an annular connection member 13 as an insert is fixed in a speaker unit assembling hole 111 of the upper housing 11 of the speaker module housing 1 through injection molding. That is, the annular connection member 13 as the insert is placed in a mold of a thermoforming vibration diaphragm 21, and corresponds to a portion of the mold for molding the speaker unit assembling hole 111. In this way, the annular connection member 13 and the molded upper housing 11 can be fixedly connected as a whole.

In step 2), a plate member 14 is electrically connected with a connection portion 132 of the annular connection member 13 described in step 1) through a conductive adhesive.

In the manufacturing method provided by the present invention, the annular connection member 13 as the insert is fixed in the upper housing 11 of the speaker module housing 1 through injection molding, so that the connection strength between the annular connection member 13 and the upper housing 11 is effectively improved and a combining force is higher. Moreover, the operation that the plate member 14 and the annular connection member 13 are electrically connected through the conductive adhesive is convenient, so that the improvement of the production efficiency is facilitated.

Although some specific embodiments of the present invention have been demonstrated in detail with examples, it should be understood by a person skilled in the art that the above examples are only intended to be illustrative but not to limit the scope of the present invention. It should be understood by those skilled in the art that the above embodiments can be modified without departing from the scope and spirit of the present invention. The scope of the present invention is defined by the appended claims.

What is claimed is:

1. A speaker module housing, comprising: an upper housing, a lower housing, an annular connection member and a plate member, wherein the annular connection member comprises a fixing portion and a connection portion; a speaker unit assembling hole is formed in the upper housing; the fixing portion of the annular connection member is fixedly connected with the speaker unit assembling hole; and the connection portion of the annular connection member is electrically connected with the plate member, and wherein the connection portion of the annular connection member is electrically connected with the plate member through a conductive adhesive.

2. The speaker module housing of claim 1, wherein the connection portion is located in an inner ring of the annular connection member; and the fixing portion is located in an outer ring of the annular connection member.

3. A speaker module housing, comprising an upper housing, a lower housing, an annular connection member and a plate member, wherein:

the annular connection member comprises a fixing portion and a connection portion;

a speaker unit assembling hole is formed in the upper housing;

the fixing portion of the annular connection member is fixedly connected with the speaker unit assembling hole;

the connection portion of the annular connection member is electrically connected with the plate member;

the connection portion is located in an inner ring of the annular connection member;

the fixing portion is located in an outer ring of the annular connection member; and a plurality of grooves and at least one signal acquisition leg are arranged at the edge of the fixing portion.

4. The speaker module housing of claim 3, wherein the annular connection member comprises a first side, a second side, a third side and a fourth side which are connected with one another end to end; the first side corresponds to the third side; the second side corresponds to the fourth side; the first and third sides are shorter than the second and fourth sides; the sizes of the grooves in the first and third sides are smaller than those of the grooves in the second and fourth sides.

5. The speaker module housing of claim 4, wherein there is one signal acquisition leg which extends from the edge of the second or fourth side towards a direction away from the lower housing.

6. The speaker module housing of claim 1, wherein the shape of the plate member is matched with that of the inner ring of the annular connection member.

7. The speaker module housing of claim 1, wherein the annular connection member is an annular steel sheet.

8. The speaker module housing of claim 1, wherein the annular connection member is designed as an insert fixedly connected with the upper housing through injection molding.

9. A manufacturing method of an upper housing of a speaker module housing, the manufacturing method comprising the following steps:

step 1), fixing a fixing portion of an annular connection member as an insert in a speaker unit assembling hole of the upper housing of the speaker module housing through injection molding; and step 2), electrically connecting the plate member with a connection portion of the annular connection member described in step 1) through a conductive adhesive.

* * * * *